US006609577B2

(12) United States Patent
Beccu

(10) Patent No.: US 6,609,577 B2
(45) Date of Patent: Aug. 26, 2003

(54) PERCUSSIVE ROTATIONAL IMPACT HAMMER

(75) Inventor: Rainer Sebastiano Beccu, Houston, TX (US)

(73) Assignee: Bark International, Inc., Houston, TX (US)

( * ) Notice: Subject to any disclaimer, the term of this patent is extended or adjusted under 35 U.S.C. 154(b) by 0 days.

(21) Appl. No.: 10/259,559

(22) Filed: Sep. 28, 2002

(65) Prior Publication Data

US 2003/0062176 A1 Apr. 3, 2003

Related U.S. Application Data

(60) Provisional application No. 60/326,061, filed on Sep. 29, 2001.

(51) Int. Cl.[7] ..... B25D 15/02

(52) U.S. Cl. ..... 173/93.6; 173/93.5; 173/17; 173/104

(58) Field of Search ..... 173/17, 15, 13, 173/109, 111, 114, 206, 93.6, 93.5, 104

(56) References Cited

U.S. PATENT DOCUMENTS 3,203,283 A * 8/1965 Newman ..... 173/93.6
4,133,393 A * 1/1979 Richards ..... 173/64
4,534,422 A * 8/1985 Rear ..... 173/206
4,862,972 A * 9/1989 Sudinshnikov et al. ..... 173/121
4,932,483 A * 6/1990 Rear ..... 175/296
5,113,950 A * 5/1992 Krasnoff ..... 173/13
5,199,505 A * 4/1993 Izumisawa ..... 173/93.6
5,305,837 A * 4/1994 Johns et al. ..... 175/61
6,491,111 B1 * 12/2002 Livingston et al. ..... 173/93.5

* cited by examiner

*Primary Examiner*—Rinaldi Rada
*Assistant Examiner*—Michelle Lopez
(74) *Attorney, Agent, or Firm*—Kenneth A. Roddy

(57) ABSTRACT

A percussive rotational impact hammer assembly for creating high torques. A generally cylindrical piston rotatably mounted on a hammer inside an outer casing oscillates on the hammer and strikes an impact surface on the hammer. The piston and housing have pressurized fluid ports and passageways for conducting pressurized fluid to alternately load an impact-driving chamber and return chamber. The piston is accelerated against the impact surface and the kinetic energy of the piston is transmitted to the hammer transmitting the rotational movement to a member engaged with the hammer, such as a drill bit or other member. The rotational impact hammer assembly can be adapted for use in a downhole hammer, in break out tongs for drill pipe, in wrenches for loosening or tightening nuts and bolts, or in other mechanical devices where high torque is desired.

20 Claims, 7 Drawing Sheets

PERCUSSIVE ROTATIONAL IMPACT HAMMER

CROSS REFERENCE TO RELATED APPLICATION

This application claims priority of U.S. Provisional Application Serial No. 60/326,081, filed Sep. 29, 2001, the pendency of which is extended until Sep. 30, 2002 under 35 U.S.C. 119(e)(3).

BACKGROUND OF THE INVENTION

1. Technical Field

This invention relates generally to percussive rotational impact hammers, and more particularly, to a percussive rotational impact hammer assembly for creating high peak torque for use in rotating a drill bit in a downhole hammer, in a wrench for loosening and tightening threaded fasteners, or in other mechanical devices where high torque is required.

2. Background Art

Rear, U.S. Pat. No. 4,932,483 discloses a downhole hammer connected to a rotatable drill string. The hammer comprises a top sub and a drill bit support separated by a tubular housing incorporating a piston chamber there between. A feed tube is mounted to the top sub and extends into the piston chamber. A piston is slidably received in the housing and over the feed tube. Fluid porting is provided in the feed tube and the piston to sequentially admit fluid in a first space between the piston and top sub to drive the piston towards the drill bit support and to a second space between the piston and the drill bit support to drive the piston towards the top sub. Rotary motion is provided to the hammer assembly and drill bit by the attached drill string powered by a rotary table typically mounted on the rig platform. A shortcoming of this design is that the whole drill string has to rotate, rather than only the bit, making it difficult to drill directional holes with, for example, coiled tubing.

Johns, et al, U.S. Pat. No. 5,305,837 discloses another downhole air percussion hammer suited for directional drilling. The air compression hammer mechanism comprises a piston that reciprocates while simultaneously rotating in its housing. A hammer drill bit slidably keyed to the bottom of the piston transfers the impact energy to the formation and rotates during operation independent of an attached drill string. The kinetic energy of the reciprocating piston is employed to rotate the bit. The linear motion of the piston is converted into rotational motion by using one or more helical grooves formed by the piston body. To prevent the piston from oscillating in the rotary mode, an indexing clutch mechanism is provided to induce bit rotation in one direction only. A shortcoming of this design is that very high damaging forces are created in the helical grooves, which adversely affects the life of the hammer.

The present invention is distinguished over the prior art in general, and these patents in particular by a percussive rotational impact hammer assembly for creating high torques wherein a generally cylindrical piston rotatably mounted on a hammer inside an outer casing oscillates on the hammer and strikes an impact surface on the hammer. The interior surface of the outer casing and exterior of the hammer form an annulus in which the piston rotatably oscillates and the piston divides the annulus into an impact-driving chamber and return chamber. The piston and hammer have pressurized fluid ports and passageways for conducting pressurized fluid to alternately pressurize the chambers to rotate the piston such that an impact face on the piston strikes an impact face on the hammer and the kinetic energy of the piston and the rotational movement is transmitted via the hammer to a member engaged with hammer, such as a drill bit or other member. The rotational impact hammer assembly can be adapted for use in a downhole hammer, in break out tongs for drill pipe, in wrenches for loosening or tightening nuts and bolts, or in other mechanical devices where high torque is desired. Another aspect of the invention is a downhole percussive hammer/drilling tool incorporating the rotational impact hammer assembly. Still another aspect of the invention is a wrench incorporating the rotational impact hammer assembly for loosening or tightening nuts and bolts or other threaded connections.

SUMMARY OF THE INVENTION

It is therefore an object of the present invention to provide a percussive rotational impact hammer assembly that can create significantly higher peak torque than conventional air hammers.

It is another object of this invention to provide a percussive rotational impact hammer assembly which can be easily adapted for use in a downhole hammer, in break out tongs for drill pipe, in wrenches for loosening or tightening nuts and bolts, or in other mechanical devices where high torque is needed.

Another object of this invention is to provide a downhole percussive rotational impact hammer having a hammer member that engages with a drilling bit by means of splines, polygon shape or similar engagement surface as the bit works in a borehole.

Another object of this invention is to provide a percussive rotational impact hammer assembly having a hammer member sized and shaped to be received in a cylindrical outer casing having a cylindrical interior surface to define an annulus between an outer cylindrical sliding surface of the hammer member and the interior surface of the outer casing in which a piston member rotatably oscillates to transmit kinetic energy and rotational movement in one direction to a member engaged with the hammer.

A further object of this invention is to provide a percussive rotational impact hammer assembly having a piston member rotatably mounted concentrically on a sliding surface of a hammer member and having an arcuate sidewall portion with an impact face and a return face disposed in circumferentially spaced relation which when rotated in a first direction forcefully strikes its impact face on an impact face of a hammer member and the kinetic energy and rotational movement is transmitted in one direction to a member engaged with the hammer member.

A still further object of this invention is to provide a percussive rotational impact hammer assembly that is simple in construction, inexpensive to manufacture and rugged and reliable in operation.

Other objects of the invention will become apparent from time to time throughout the specification and claims as hereinafter related.

The above noted objects and other objects of the invention are accomplished by a percussive rotational impact hammer assembly for creating high torques wherein a generally cylindrical piston rotatably mounted on a hammer inside an outer casing oscillates on the hammer and strikes an impact surface on the hammer. The interior surface of the outer casing and exterior of the hammer form an annulus in which the piston rotatably oscillates and the piston divides the annulus into an impact-driving chamber and return chamber.

The piston and hammer have pressurized fluid ports and passageways for conducting pressurized fluid to alternately pressurize the chambers to rotate the piston such that an impact face on the piston strikes an impact face on the hammer and the kinetic energy of the piston and the rotational movement is transmitted via the hammer to a member engaged with hammer, such as a drill bit or other member. The rotational impact hammer assembly can be adapted for use in a downhole hammer, in break out tongs for drill pipe, in wrenches for loosening or tightening nuts and bolts, or in other mechanical devices where high torque is desired. Another aspect of the invention is a downhole percussive hammer/drilling tool incorporating the rotational impact hammer assembly. Still another aspect of the invention is a wrench incorporating the rotational impact hammer assembly for loosening or tightening nuts and bolts or other threaded connections.

DESCRIPTION OF THE PREFERRED EMBODIMENTS

Figure 1:
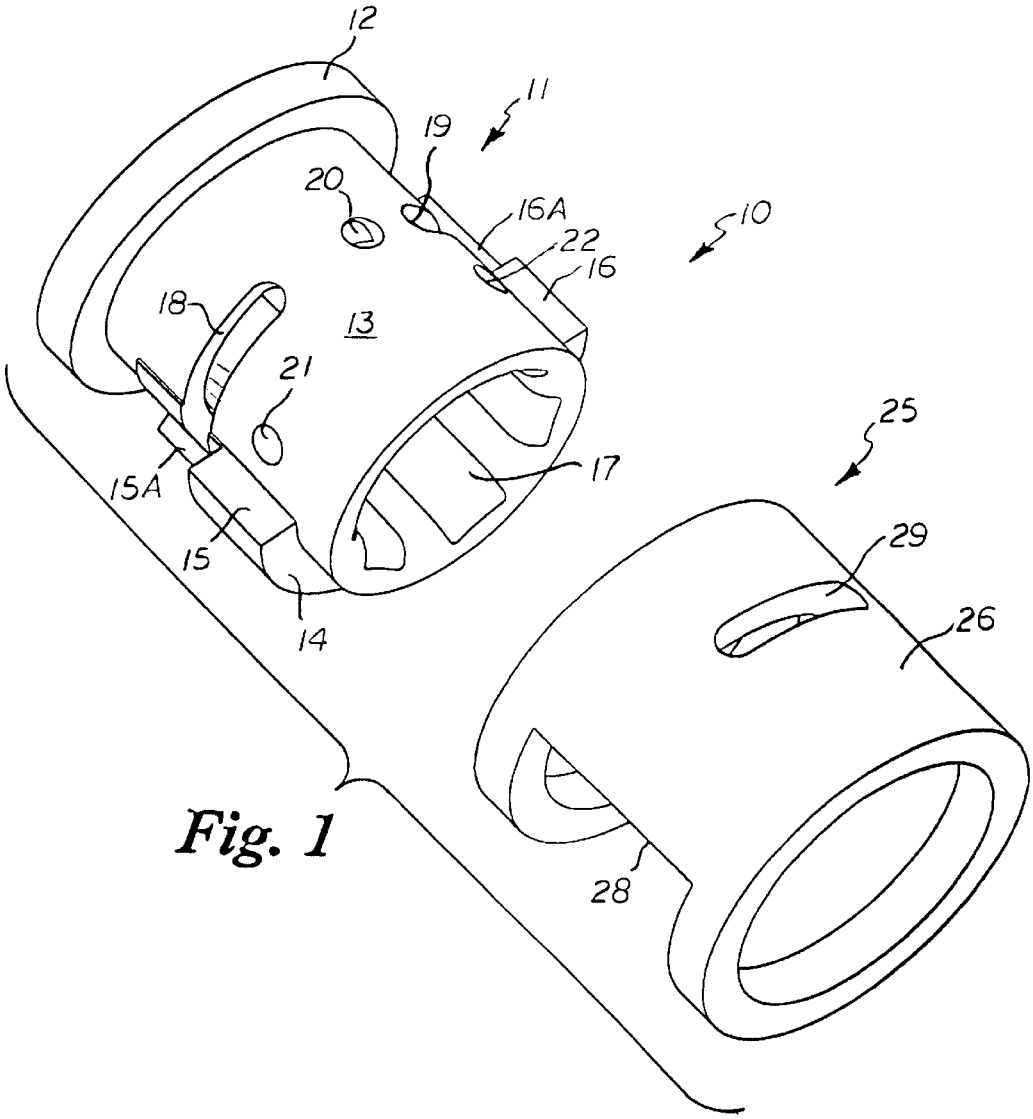
FIG. 1 is an exploded isometric view of the hammer and piston members of the percussive rotational impact hammer assembly in accordance with the present invention, shown in an unassembled condition.
Figure 2:
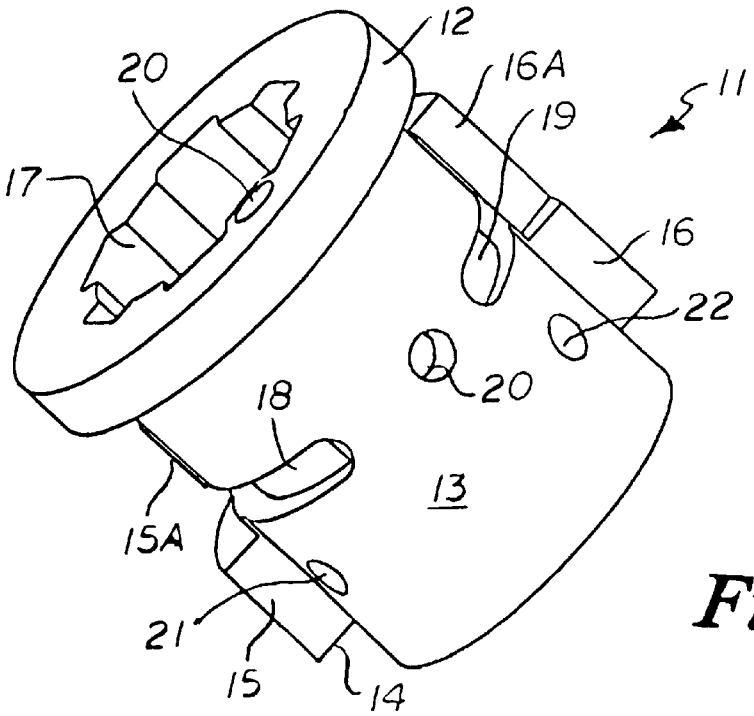
FIG. 2 is an isometric view of the hammer member shown from the top and rotated slightly from the position shown in FIG. 1.
Figure 3:
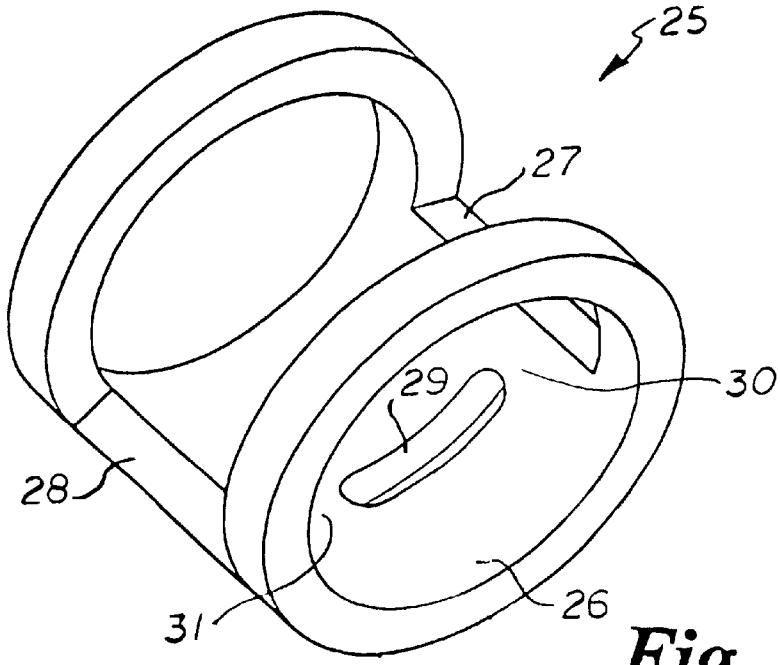
FIG. 3 is an isometric view of the piston member, shown rotated 180° from the position shown in FIG. 1.

Referring to the drawings by numerals of reference, a percussive rotational impact hammer assembly 10 in accordance with the present invention is shown in an unassembled condition in FIG. 1. The percussive rotational impact hammer assembly 10 includes a hammer member 11 and a piston member 25. FIG. 2 shows the hammer member 11 as seen from the top and rotated slightly from the position shown in FIG. 1. FIG. 3 shows the piston member 25 rotated 180° from the position shown in FIG. 1.

The hammer 11 is a generally cylindrical member with a side wall having a larger diameter circular top portion 12 and a reduced diameter lower portion 13. The reduced diameter lower portion 13 has a semi-circular raised anvil surface 14 near its bottom end extending partially around its circumference with opposed ends terminating a distance apart to define a raised impact face 15 and a raised return face 16 disposed in circumferentially spaced relation. The raised faces 15 and 16 have stepped upper portions 15 A and 16 A that are disposed a short distance circumferentially beyond the faces 15 and 16. The interior of the hammer 11 is provided with a longitudinal engagement surface 17, such as a splined or polygonal surface, for receiving and engaging a member to be rotated, or a shaft connected with the tool to be rotated.

A circumferential impact passageway 18 and a circumferential return passageway 19 formed in the outer surface of the reduced diameter portion 13 of the hammer side wall extend partially around the circumference of the reduced diameter portion and their opposed facing ends terminate a distance apart. The passageways 18 and 19 are shallow and do not extend through the side wall to the interior of the hammer. A pressurized air supply port 20 extends longitudinally from the top surface of the top portion 12 of the hammer 11 and exits outwardly through exterior of the reduced diameter portion 13 between the opposed facing ends of the passageways 18 and 19. An impact air exhaust port 21 and a return air exhaust port 22 disposed beneath the passageways 18 and 19 in circumferentially spaced relation extend through the reduced diameter portion 13 of the hammer side wall to the interior of the hammer.

The piston 25 is a hollow cylindrical member having a circumferential portion of its side wall intermediate its ends removed to define a remaining arcuate side wall portion 26 with an impact driving face 27 and a return driving face 28 disposed in circumferentially spaced relation. A circumferential slotted passageway 29 extends through the arcuate portion 26 of the piston side wall and its outer ends terminate a distance inwardly from the faces 27 and 28. The portions of the arcuate side wall at each side of the outer ends of the passageway 29 define an impact sealing surface 30 and a return sealing surface 31. The impact sealing surface 30 serves to seal an impact chamber for pressurized air, and the return sealing surface 31 serves to seal a return chamber for pressurized air, as described hereinafter.

In the assembled condition, the piston 25 is mounted concentrically on the exterior of the hammer 11 for relative rotational movement about a central longitudinal axis. This may be accomplished by constructing the piston 25 in two halves and securing them together around the hammer 11 by welding, fasteners or by other means well known in the art, such that the piston is free to rotatably oscillate relative to the hammer and its impact driving face 27 and return driving face 28 will engage the raised impact and return faces 15 and 16 of the hammer.

Figure 4:
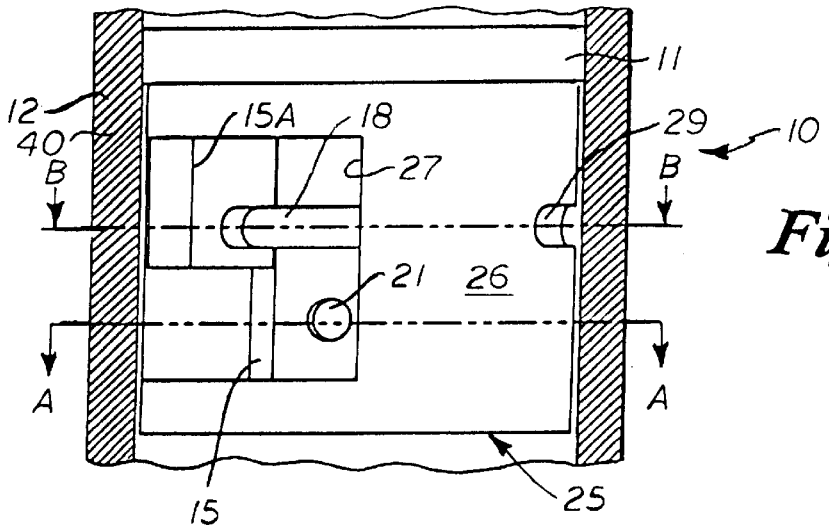
FIG. 4 is a side elevation view of the assembled hammer and piston installed in an outer cylindrical casing, with the outer casing shown in cross section and the components shown in a first position.
Figure 4A:
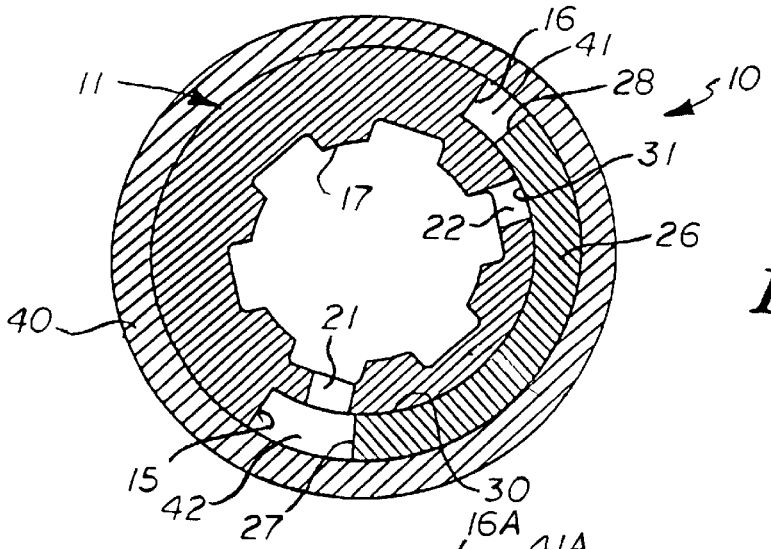
FIG. 4A is a transverse cross section taken along line A—A of FIG. 4, with the outer casing shown in full, showing the air outlet ports of the hammer and the piston in the first position.
Figure 4B:
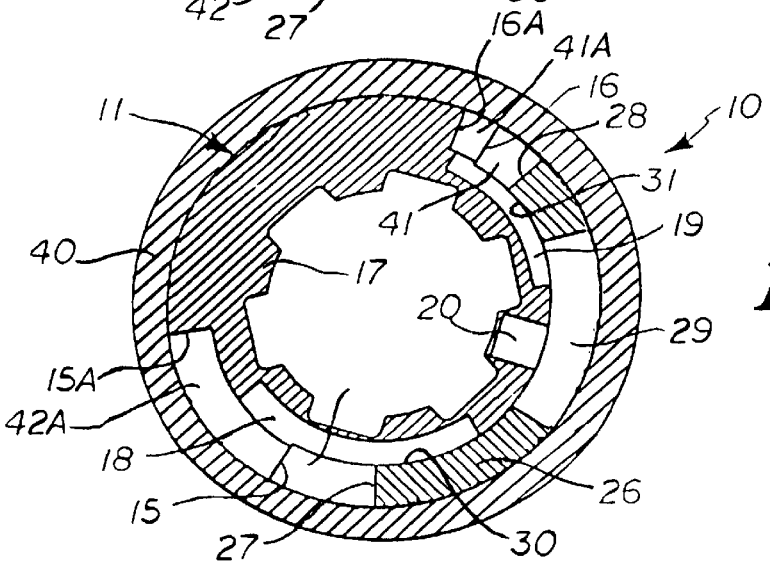
FIG. 4B is a transverse cross section taken along line B—B of FIG. 4, showing the air inlet port, impact passageway, and return passageway of the hammer and the passageway of the piston in the first position.

As shown in FIGS. 4, 4A and 4B, the percussive rotational impact hammer assembly 10 is installed in a cylindrical outer casing 40, which may be a cylindrical portion of a downhole hammer, break out tongs for drill pipe, a wrench for loosening or tightening nuts and bolts, or other mechanical device where high torque is needed. When installed in the outer casing 40, the cylindrical inner surface of the casing is spaced concentrically to the outer cylindrical surface of the hammer 11 to form an annulus between the raised impact and return faces 15 and 16 of the hammer. The arcuate portion 26 of the piston side wall divides the annulus into a return chamber 41 and an impact chamber 42. The upper portion of the return chamber 41 and impact chamber 42 extends a short distance circumferentially beyond the impact faces 15 and 16 terminating at the stepped upper portions 15A and 16A of the impact faces defining small end chambers 41A and 42A.

Pressurized air is constantly delivered to the air supply port 20 of the hammer 11 while the rotational impact hammer is in use. In a first position, the outlet of the air supply port 20 is in communication with the passageway 29 extending through the arcuate portion 26 of the piston side wall. The piston passageway 29 is in communication with either of the impact passageway 18 or return passageway 19 on the outer surface of the side wall 13 of the hammer 11, depending on the location of the piston 25. The impact passageway 18 and return passageway 19 are in communication with the return chamber 41 and the impact chamber 42. The impact and return sealing surfaces 30 and 31 on the interior of the arcuate portion 26 of the piston side wall on each side of the passageway 29 will alternately seal off one of the exhaust ports 21 or 22 preventing communication between either the return chamber 41 or the impact chamber 42 and the interior of the hammer 11 while allowing communication through the other exhaust port between either the return chamber or the impact chamber, depending on the location of the piston 25.

In the position shown in FIGS. 4, 4A and 4B, the piston passageway 29 is in communication with the return passageway 19 on the outer surface of the side wall 13 of the hammer 11, the return sealing surface 31 has closed off the return air exhaust port 22 preventing air from exhausting from the return chamber 41 into the interior of the hammer and the impact sealing surface 30 allows air to exhaust from the impact chamber 42 into the interior of the hammer through impact exhaust port 21, reducing the pressure therein and has closed off flow of pressurized air from the air supply port 20 to the impact chamber 42. Thus, pressurized air passes from the air supply port 20 through the return passageway 19 into the return chamber 41.

Figure 5:
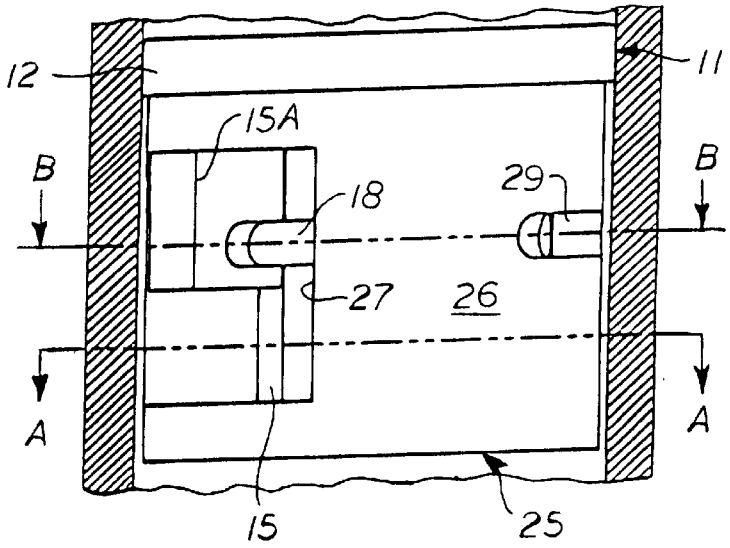
FIG. 5 is a side elevation view of the assembled hammer and piston installed in an outer cylindrical casing, with the outer casing shown in cross section and the piston shown in an intermediate position.
Figure 5A:
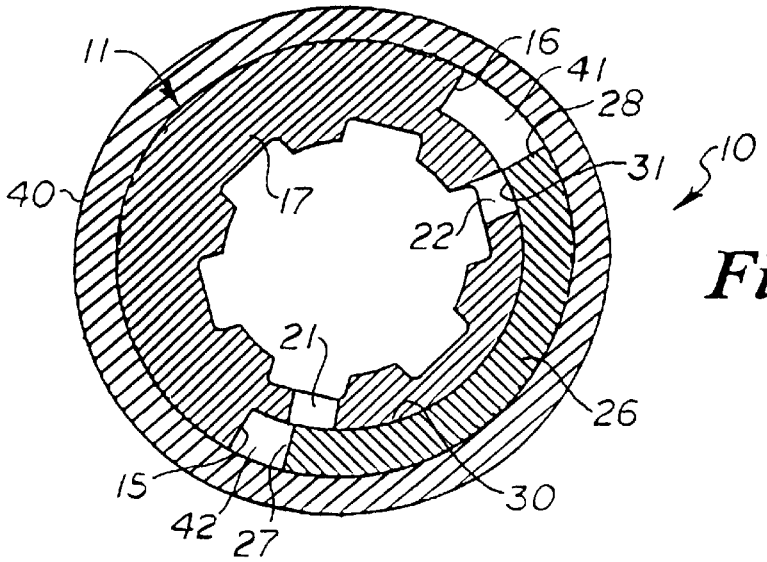
FIG. 5A is a transverse cross section taken along line A—A of FIG. 5, with the outer casing shown in full, showing the air outlet ports of the hammer and the piston in the intermediate position.
Figure 5B:
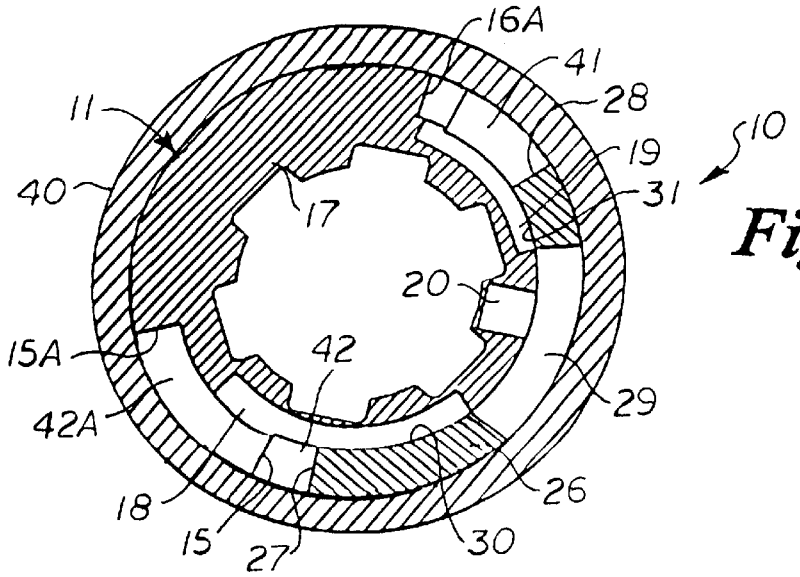
FIG. 5B is a transverse cross section taken along line B—B of FIG. 5, showing the air inlet port, impact passageway, and return passageway of the hammer and the passageway of the piston in the intermediate position.

As shown in FIGS. 5, 5A and 5B, as pressurized air fills the return chamber 41 bounded by the return face 16 of the hammer 11 and the return driving face 28 of the piston 25, the piston will begin to rotate relative to the hammer in a clockwise direction toward the impact face 15 of the hammer. Thus, the air in the impact chamber 42 begins to be compressed as the piston rotates to the impact position.

Figure 6:
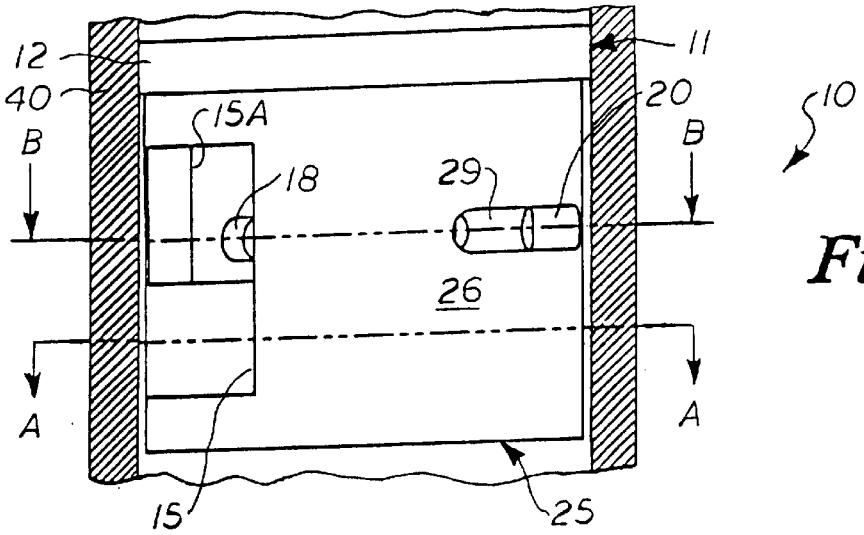
FIG. 6 is a side elevation view of the assembled hammer and piston installed in an outer cylindrical casing, with the outer casing shown in cross section and the piston shown in an impact position.
Figure 6A:
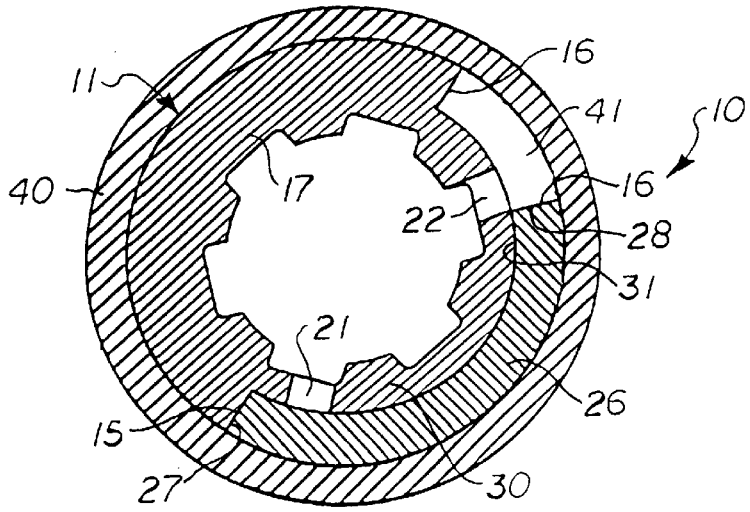
FIG. 6A is a transverse cross section taken along line A—A of FIG. 6, with the outer casing shown in full, showing the air outlet ports of the hammer and the piston in the impact position.
Figure 6B:
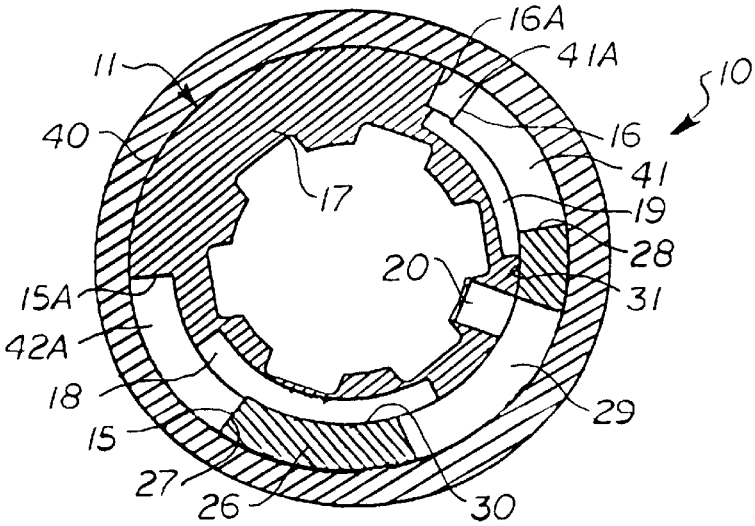
FIG. 6B is a transverse cross section taken along line B—B of FIG. 6, showing the air inlet port, impact passageway, and return passageway of the hammer and the passageway of the piston in the impact position.

FIGS. 6, 6A and 6B show the piston in the impact position. As pressurized air fills the return chamber 41 and the piston 25 rotates, the impact face 27 of the piston forcefully strikes the impact face 15 of the hammer. A shock wave will be transferred through the hammer impact face 15 of the hammer 11, causing it to rotate and transfer kinetic energy and rotational motion to member engaged with the engagement surface 17 of the hammer.

When the piston 25 has reached the impact position, the sealing surface 12 closes off the return passageway 19 on the outer surface of the side wall 13 of the hammer 11 preventing flow of pressurized air from the air supply port 20 to the return chamber 41, and the impact sealing surface 30 closes off the impact air exhaust port 21 preventing air from flowing from the impact chamber 42 into the interior of the hammer and allows air to exhaust from the return chamber 41 into the interior of the hammer through return air exhaust port 22, thus dumping the pressure therein. The piston passageway 29 remains in communication with the air supply port 20 and the pressurized air passes from the air supply port to the impact chamber 42 through the impact passageway 18 on the outer surface of the side wall 13 of the hammer 11 and the impact chamber 42 becomes pressurized to return the piston to the first position shown in FIGS. 4, 4A and 4B.

The small end chambers 41A and 42A at the upper end portions of the return chamber 41 and impact chamber 42 defined by the stepped upper portions 15A and 16A of the impact and return faces 15 and 16 extend a distance circumferentially beyond the impact and return faces and is not closed off during the cycle to prevent sticking.

The piston 25 will be rotated back to the first position due to rebound from the impact face 15 of the hammer and the supply of pressurized air through the passageways 20, 29, and 18. The piston 25 will close the impact passageway 18 while moving back to the first position so that the hammer return passageway 19 is able to pressurize the return chamber 41, and will open the impact air exhaust port 21 emptying the impact chamber 42. Thus, the cycle is completed and the rotational impact piston 25 will now accelerate again against the hammer impact face 15. The above-described cycle will continue as long as the pressurized air is supplied to the rotational impact hammer.

It should be understood that the ports, passageways, and faces of the piston and hammer are spaced relative to one another to achieve the cyclical movement described above and that other combinations of ports, passageways, and faces could be employed to achieve the reciprocating motion of the piston. It should also be understood that the same result of movement of the piston may be achieved with an arrangement of external or internal valves controlled by air, hydraulics or electricity.

Figure 7A:
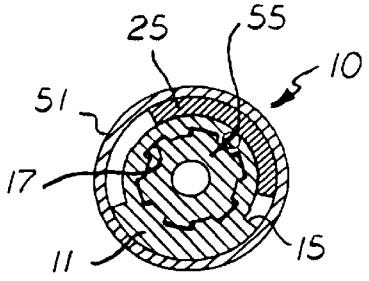
FIG. 7A is a transverse cross section view of the downhole hammer taken along line A—A of FIG. 7.
Figure 7:
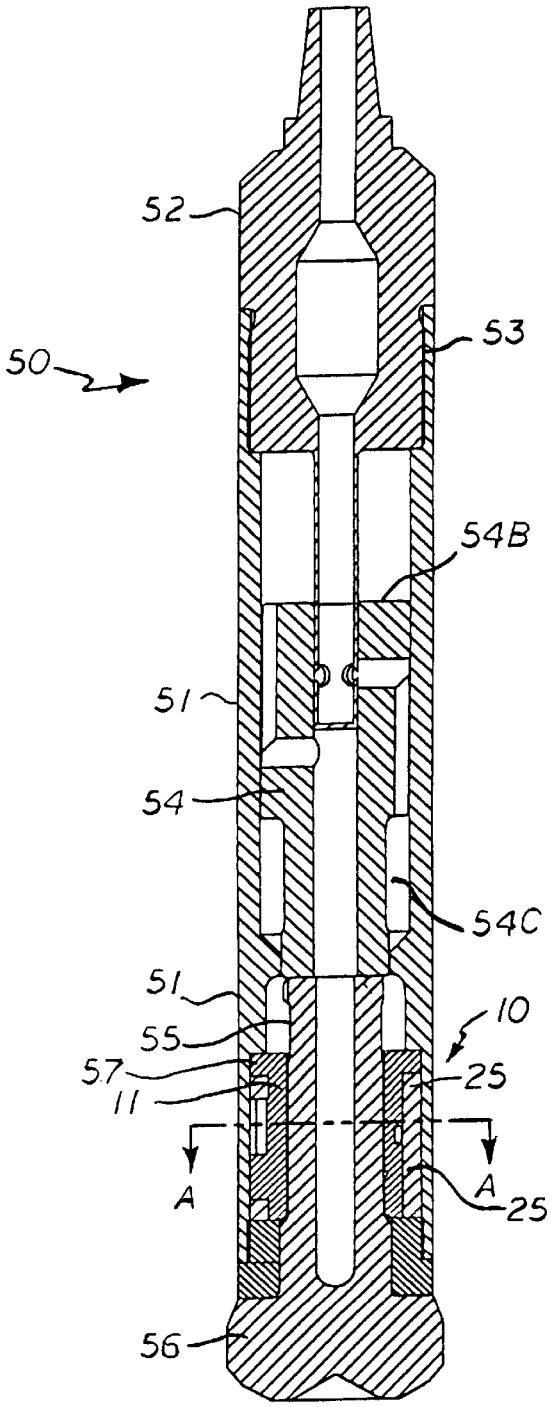
FIG. 7 is a longitudinal cross section showing somewhat schematically a downhole hammer having a percussive rotational impact hammer assembly in accordance with the present invention.

FIGS. 7 and 7A show a preferred embodiment of a downhole hammer 50 having a percussive rotational impact hammer assembly 10 according to the present invention. The hammer assembly 10 is mounted in an outer cylindrical casing 51 that is connectable to a drill pipe string (not shown) by means of a top sub 52, through which pressurized air is conducted. The outer casing 51 is connected to the top sub 52 by threads 53. An upper piston 54 reciprocates in the cylindrical casing 51, and pressurized working air is conducted through internal passageways 54 alternately to the upper end 54B and lower end 54C of the upper piston to effect its reciprocation in the outer cylindrical casing 51, as is well known in art.

Each downward stroke of the upper piston 54 inflicts an impact blow upon the anvil portion 55 of a drill bit 56 mounted within the hammer 11 of the percussive rotational impact hammer assembly 10 at the lower portion of the cylindrical casing 51. A shock wave will be transferred through the bit to carbide inserts on the front surface of the drill bit 56, thereby crushing rock material. The bit is simultaneously rotated via the rotational impact hammer assembly 10. Pressurized air is supplied to the hammer 11 of the percussive rotational impact hammer assembly 10 from the lower piston end 54C via channels 54A (or through air channels in the casing 51 ) to the air supply port 20 of the hammer, and the piston 25 is rotated impacting against the hammer impact face 15, as previously described. This rotational movement is then transferred to the drill bit 56 over the engaging surface 17 of the hammer, such as splines or other engagement means between the bit and the hammer member. To prevent the rotational impact hammer from oscillating, an indexing clutch mechanism, pawl or a ratchet or similar device 57 known in the art is provided to allow bit rotation in one direction only. The drill bit 56 rotates independently of the downhole hammer and drill string.

Figure 8:
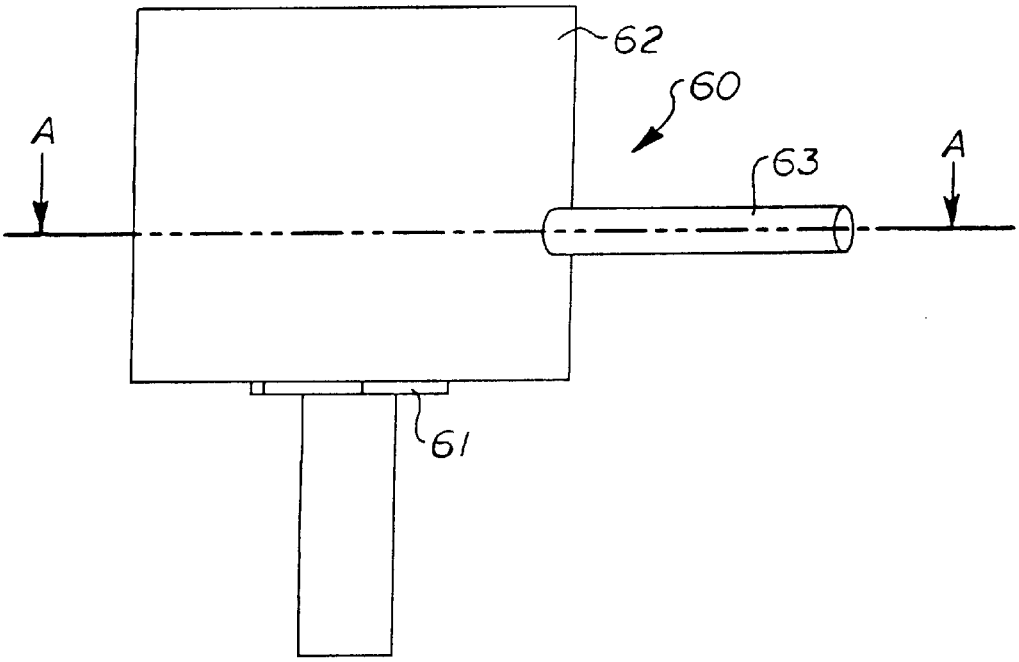
FIG. 8 is a side elevation showing somewhat schematically a wrench having a percussive rotational impact hammer assembly in accordance with the present invention.
Figure 8A:
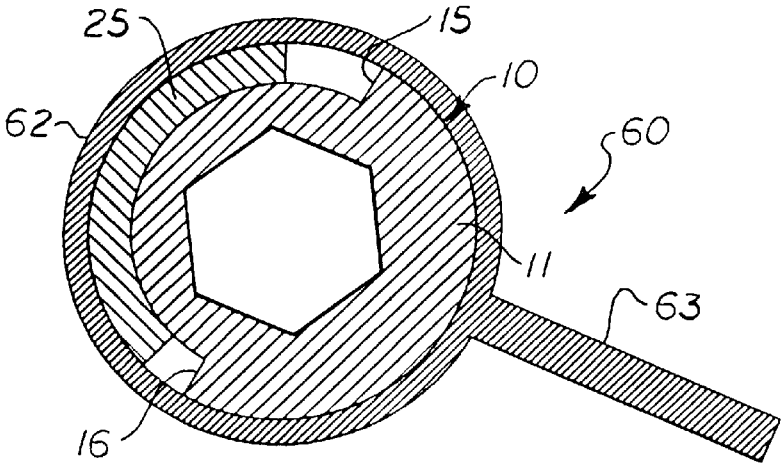
FIG. 8A is a transverse cross section view of the wrench taken along line A—A of FIG. 8.

FIGS. 8 and 8A illustrate an example of a wrench 60 having a percussive rotational impact hammer assembly 10 in accordance with the present invention for loosening or tightening a threaded member such as a bolt or a nut 61, a threadedly connected rod or tube, or other assembly that requires high torque. The wrench 60 has an outer casing 62 in which the rotational impact hammer assembly 10 is installed, and is equipped with a handle 63 for ease of operation. When pressurized air is delivered to the hammer 11, the piston 25 rotates to strike against the hammer impact face 15. The rotational movement is transferred to the nut or bolt 61 via the engagement surface 17 of the hammer, which, in this case is in the shape of the nut or bolt itself. The orientation of the hammer 11 will determine the direction of the rotation.

The calculations presented below indicate that much higher peak torques can be achieved with the present percussive rotational impact hammer assembly compared with conventional air motors.

Conventional Air Motor, C

The momentum $M_c$, can be expressed $$M_C = F_C D \frac{1}{2}: \tag{1}$$

where: $F_C$ is the force and D the diameter.

The driving force $$F_C = Ap: \tag{2}$$

where: A is the driving area and p is the acting pressure

Impact motor, I.

The momentum $M_I$, can be expressed $$M_I = F_I D \frac{1}{2}: \tag{3}$$

where: $F_I$ is the impact force and D the diameter.

$$F_I = \frac{1}{2} vAE/c: \tag{4}$$

where: v is the impact velocity, A is the area, E is the Young's modulus and c is the wave speed.

Newton's first law applied on the impact piston $$F_d = ma \tag{5}$$

where: m is the mass of the piston and a is the acceleration.

Piston driving force $F_d$ $$F_d = Ap: \tag{6}$$

where: A is the area and p is the acting pressure.

(5),(6) and m=Alρ and l is the length of the piston and ρ is the density of the piston $$a = p/l\rho \tag{7}$$

The acceleration a, can be expressed as $$a = v^2 \frac{1}{2s} \tag{8}$$

where: v is the impact velocity and s is the piston stroke.

(7) and (8)

$$v^2 \frac{1}{2s} = p/l\rho \tag{9}$$

(9), (4) and $c^2 = E/\rho$ $$F_I = \frac{1}{2}\sqrt{\frac{2sp}{l\rho}}\, AE/c = \sqrt{\frac{spE}{2l}}\, A \tag{10}$$

(10) and (3)

$$M_I = \sqrt{\frac{spE}{2l}}\, AD\frac{1}{2} \tag{11}$$

The ratio $\lambda = M_I/M_C$, typical values would be that the length l of the piston is 10 times longer than the stroke s, Youngs modulus E for steel is 210 GPa and a typical value for a pressurized air is 30E5 Pa $$\lambda = \sqrt{\frac{1}{2}\frac{s}{l}\frac{E}{p}} = \sqrt{\frac{1}{2}\frac{1}{10}\frac{210E9}{30E5}} \approx 60$$

Thus, it may be concluded that the peak torque generated with the present percussive rotational impact hammer assembly could easily be 60 times higher than with a conventional air motor.

While this invention has been described fully and completely with special emphasis upon preferred embodiments, it should be understood that within the scope of the appended claims the invention may be practiced otherwise than as specifically described herein.

What is claimed is:

1. A percussive rotational impact hammer assembly adapted to be installed in an outer casing for rotating a member, the hammer assembly comprising:

a generally cylindrical hammer member having an interior engagement surface for engaging a member to be rotated, and an outer cylindrical sliding surface with a raised impact face and a raised return face disposed in circumferentially spaced relation;

a hollow generally cylindrical piston member rotatably mounted concentrically on said hammer sliding surface and having an arcuate sidewall portion with an impact face and a return face disposed in circumferentially spaced relation, said hammer member sized and shaped to be received in a cylindrical outer casing having a cylindrical interior surface to define an annulus between said outer cylindrical sliding surface and the interior surface of the outer casing in which said piston rotatably oscillates, and said piston arcuate sidewall dividing the annulus into an impact chamber between said hammer impact face and said piston impact face and a return chamber between said hammer return face and said piston return face; and fluid conducting ports and passageways in said hammer member and said piston member for conducting pressurized fluid in pathways to alternately pressurize said return chamber and said impact chamber to rotatably oscillate said piston, such that upon pressurization of said return chamber said piston is rotated in a first direction to forcefully strike its said impact face on said hammer impact face and the kinetic energy of said piston and rotational movement is transmitted via said hammer member to the member engaged with said interior engagement surface, and upon pressurization of said impact chamber said piston is rotated in a reverse direction.

2. The percussive rotational impact hammer assembly according to claim 1, wherein said hammer member comprises a generally cylindrical member with a side wall having a larger diameter circular portion and a reduced diameter portion defining said sliding surface; and a semi-circular raised anvil surface on said reduced diameter portion extending partially around its circumference with opposed ends terminating a distance apart to define its said raised impact face said raised return-face.

3. The percussive rotational impact hammer assembly according to claim 2, wherein said piston member comprises a hollow cylindrical member having a circumferential portion of its side wall intermediate its ends removed to define a remaining arcuate side wall portion with the circumferentially spaced sides thereof defining its said impact face and return face.

4. The percussive rotational impact hammer assembly according to claim 3, wherein said fluid conducting ports and passageways in said hammer member comprise a circumferential impact passageway and a circumferential return passageway formed in an outer surface of said reduced diameter portion and extending partially around the circumference thereof and having opposed facing ends terminating a distance apart;

a pressurized air supply port extending longitudinally through said hammer side having an inlet at one end thereof and an outlet exiting through exterior of said reduced diameter portion between said opposed facing ends of said impact and return passageways; and an impact air exhaust port and a return air exhaust port extending through said reduced diameter portion to the interior of said hammer member in circumferentially spaced relation.

5. The percussive rotational impact hammer assembly according to claim 4, wherein said fluid conducting ports and passageways in said piston member comprise a circumferential slotted passageway extending through said arcuate portion of said arcuate side wall portion with outer ends terminating a distance inwardly from its said impact face and return face, and lateral portions of said arcuate side wall at each side of said passageway outer ends defining an impact sealing surface and a return sealing surface for alternately opening and closing said impact air exhaust port and return air exhaust port and communication through said impact passageway and return passageway.

6. The percussive rotational impact hammer assembly according to claim 5, wherein in use, pressurized air is constantly delivered to said air inlet port of said hammer member;

when said piston is in a first position, said slotted passageway in said arcuate portion of said piston side wall is in communication with said air supply port and with said return passageway on said hammer member and said return sealing surface of said piston member closes off said return exhaust port in said hammer member preventing air from flowing from said return chamber into the interior of said hammer member and said impact surface opens said impact exhaust port to allow air to exhaust from said impact chamber into said interior and closes off flow of pressurized air from said air supply port to said impact chamber, such that pressurized air passes from said air supply port through said return passageway into said return chamber;

as pressurized air fills said return chamber bounded by said hammer member return face and said piston member return face, said piston member begins to rotate in a direction toward said hammer member impact face to an impact position such that said impact face of said piston forcefully strikes said impact face of said hammer member and the kinetic energy of said piston member and rotational movement is transmitted via said hammer member to the member engaged with said interior engagement surface; and upon reaching the impact position said return sealing surface of piston member closes off said return passageway on said hammer member preventing flow of pressurized air from said air supply port to said return chamber, and said impact sealing surface closes off said impact exhaust port in said hammer member preventing air from flowing from said impact chamber into said hammer member interior and opens said return exhaust port to exhaust air from said return chamber into the interior of said hammer member, said slotted passageway in said arcuate portion of said piston side wall remains in communication with said air supply port and pressurized air passes from said air supply port through said impact passageway into said impact chamber and said impact chamber becomes pressurized to return the piston to the first position aided by the rebound force from striking said impact face of said hammer member.

7. The percussive rotational impact hammer assembly according to claim 6, wherein said impact face and said return face of said hammer member each have a stepped upper portion extending a distance circumferentially beyond said impact and return faces defining a small end chamber at the ends of said impact chamber and said return chamber which is not closed off during the cycle to prevent said piston from sticking.

8. A percussive rotational impact hammer assembly for rotating a member, the hammer assembly comprising:

a generally cylindrical outer casing having a cylindrical interior surface;

a generally cylindrical hammer member in said outer casing cylindrical interior surface having an interior engagement surface for engaging a member to be rotated, and an outer cylindrical sliding surface with a raised impact face and a raised return face disposed in circumferentially spaced relation;

a hollow generally cylindrical piston member rotatably mounted concentrically on said hammer sliding surface and having an arcuate sidewall portion with an impact face and a return face disposed in circumferentially spaced relation, said hammer member sized and shaped to define an annulus between its said outer cylindrical sliding surface and the interior surface of the outer casing in which said piston rotatably oscillates, and said piston arcuate sidewall dividing the annulus into an impact chamber between said hammer impact face and said piston impact face and a return chamber between said hammer return face and said piston return face; and fluid conducting ports and passageways in said hammer member and said piston member for conducting pressurized fluid in pathways to alternately pressurize said return chamber and said impact chamber to rotatably oscillate said piston, such that upon pressurization of said return chamber said piston is rotated in a first direction to forcefully strike its said impact face on said hammer impact face and the kinetic energy of said piston and rotational movement is transmitted via said hammer member to the member engaged with said interior engagement surface, and upon pressurization of said impact chamber said piston is rotated in a reverse direction.

9. The percussive rotational impact hammer assembly according to claim 8, wherein said hammer member comprises a generally cylindrical member with a side wall having a larger diameter circular portion and a reduced diameter portion defining said sliding surface; and a semi-circular raised anvil surface on said reduced diameter portion extending partially around its circumference with opposed ends terminating a distance apart to define its said raised impact face said raised return face.

10. The percussive rotational impact hammer assembly according to claim 9, wherein said piston member comprises a hollow cylindrical member having a circumferential portion of its side wall intermediate its ends removed to define a remaining arcuate side wall portion with the circumferentially spaced sides thereof defining its said impact face and return face.

11. The percussive rotational impact hammer assembly according to claim 10, wherein said fluid conducting ports and passageways in said hammer member comprise a circumferential impact passageway and a circumferential return passageway formed in an outer surface of said reduced diameter portion and extending partially around the circumference thereof and having opposed facing ends terminating a distance apart;

a pressurized air supply port extending longitudinally through said hammer side having an inlet at one end thereof and an outlet exiting through exterior of said reduced diameter portion between said opposed facing ends of said impact and return passageways; and an impact air exhaust port and a return air exhaust port extending through said reduced diameter portion to the interior of said hammer member in circumferentially spaced relation.

12. The percussive rotational impact hammer assembly according to claim 11, wherein said fluid conducting ports and passageways in said piston member comprise a circumferential slotted passageway extending through said arcuate side wall portion with outer ends terminating a distance inwardly from its said impact face and return face, and lateral portions of said arcuate side wall at each side of said passageway outer ends defining an impact sealing surface and a return sealing surface for alternately opening and closing said impact air exhaust port and return air exhaust port and communication through said impact passageway and return passageway.

13. The percussive rotational impact hammer assembly according to claim 12, wherein in use, pressurized air is constantly delivered to said air inlet port of said hammer member;

when said piston is in a first position, said slotted passageway in said arcuate portion of said piston side wall is in communication with said air supply port and with said return passageway on said hammer member and said return sealing surface of said piston member closes off said return exhaust port in said hammer member preventing air from flowing from said return chamber into the interior of said hammer member and said impact surface opens said impact exhaust port to allow air to exhaust from said impact chamber into said interior and closes off flow of pressurized air from said air supply port to said impact chamber, such that pressurized air passes from said air supply port through said return passageway into said return chamber;

as pressurized air fills said return chamber bounded by said hammer member return face and said piston member return face, said piston member begins to rotate in a direction toward said hammer member impact face to an impact position such that said impact face of said piston forcefully strikes said impact face of said hammer member and the kinetic energy of said piston member and rotational movement is transmitted via said hammer member to the member engaged with said interior engagement surface; and upon reaching the impact position said return sealing surface of piston member closes off said return passageway on said hammer member preventing flow of pressurized air from said air supply port to said return chamber, and said impact sealing surface closes off said impact exhaust port in said hammer member preventing air from flowing from said impact chamber into said hammer member interior and opens said return exhaust port to exhaust air from said return chamber into the interior of said hammer member, said slotted passageway in said arcuate portion of said piston side wall remains in communication with said air supply port and pressurized air passes from said air supply port through said impact passageway into said impact chamber and said impact chamber becomes pressurized to return the piston to the first position aided by the rebound force from striking said impact face of said hammer member.

14. The percussive rotational impact hammer assembly according to claim 13, wherein said impact face and said return face of said hammer member each have a stepped upper portion extending a distance circumferentially beyond said impact and return faces defining a small end chamber at the ends of said impact chamber and said return chamber which is not closed off during the cycle to prevent said piston from sticking.

15. A downhole percussive rotational impact hammer assembly for rotating a bit, comprising:

an elongate downhole tool having a generally cylindrical portion with a cylindrical interior surface;

a generally cylindrical hammer member in said cylindrical interior surface having an interior engagement surface for engaging a bit to be rotated, and an outer cylindrical sliding surface with a raised impact face and a raised return face disposed in circumferentially spaced relation;

a hollow generally cylindrical piston member rotatably mounted concentrically on said hammer sliding surface and having an arcuate sidewall portion with an impact face and a return face disposed in circumferentially spaced relation, said hammer member sized and shaped to define an annulus between its said outer cylindrical sliding surface and said interior surface in which said piston rotatably oscillates, and said piston arcuate sidewall dividing the annulus into an impact chamber between said hammer impact face and said piston impact face and a return chamber between said hammer return face and said piston return face; and fluid conducting ports and passageways in said hammer member and said piston member for conducting pressurized fluid in pathways to alternately pressurize said return chamber and said impact chamber to rotatably oscillate said piston, such that upon pressurization of said return chamber said piston is rotated in a first direction to forcefully strike its said impact face on said hammer impact face and the kinetic energy of said piston and rotational movement is transmitted via said hammer member to the member engaged with said interior engagement surface, and upon pressurization of said impact chamber said piston is rotated in a reverse direction.

16. The downhole percussive rotational impact hammer assembly according to claim 15, wherein said hammer member comprises a generally cylindrical member with a side wall having a larger diameter circular portion and a reduced diameter portion defining said sliding surface, and a semi-circular raised anvil surface on said reduced diameter portion extending partially around its circumference with opposed ends terminating a distance apart to define its said raised impact face said raised return face; and said piston member comprises a hollow cylindrical member having a circumferential portion of its side wall intermediate its ends removed to define a remaining arcuate side wall portion with the circumferentially spaced sides thereof defining its said impact face and return face.

17. The downhole percussive rotational impact hammer assembly according to claim 16, wherein said fluid conducting ports and passageways in said hammer member comprise a circumferential impact passageway and a circumferential return passageway formed in an outer surface of said reduced diameter portion and extending partially around the circumference thereof and having opposed facing ends terminating a distance apart;

a pressurized air supply port extending longitudinally through said hammer side having an inlet at one end thereof and an outlet exiting through exterior of said reduced diameter portion between said opposed facing ends of said impact and return passageways; and an impact air exhaust port and a return air exhaust port extending through said reduced diameter portion to the interior of said hammer member in circumferentially spaced relation; and said fluid conducting ports and passageways in said piston member comprise a circumferential slotted passageway extending through said arcuate side wall portion with outer ends terminating a distance inwardly from its said impact face and return face, and lateral portions of said arcuate side wall at each side of said passageway outer ends defining an impact sealing surface and a return sealing surface for alternately opening and closing said impact air exhaust port and return air exhaust port and communication through said impact passageway and return passageway.

18. A percussive rotational impact wrench assembly for tightening or loosening a member of a threaded connection, comprising:

a wrench having a body portion with a cylindrical interior surface;

a generally cylindrical hammer member in said cylindrical interior surface having an interior engagement surface for engaging a member of a threaded connection to be rotated, and an outer cylindrical sliding surface with a raised impact face and a raised return face disposed in circumferentially spaced relation;

a hollow generally cylindrical piston member rotatably mounted concentrically on said hammer sliding surface and having an arcuate sidewall portion with an impact face and a return face disposed in circumferentially spaced relation, said hammer member sized and shaped to define an annulus between its said outer cylindrical sliding surface and said interior surface in which said piston rotatably oscillates, and said piston arcuate sidewall dividing the annulus into an impact chamber between said hammer impact face and said piston impact face and a return chamber between said hammer return face and said piston return face; and fluid conducting ports and passageways in said hammer member and said piston member for conducting pressurized fluid in pathways to alternately pressurize said return chamber and said impact chamber to rotatably oscillate said piston, such that upon pressurization of said return chamber said piston is rotated in a first direction to forcefully strike its said impact face on said hammer impact face and the kinetic energy of said piston and rotational movement is transmitted via said hammer member to the member engaged with said interior engagement surface, and upon pressurization of said impact chamber said piston is rotated in a reverse direction.

19. The percussive rotational impact wrench assembly according to claim 18, wherein said hammer member comprises a generally cylindrical member with a side wall having a larger diameter circular portion and a reduced diameter portion defining said sliding surface, and a semi-circular raised anvil surface on said reduced diameter portion extending partially around its circumference with opposed ends terminating a distance apart to define its said raised impact face said raised return face; and said piston member comprises a hollow cylindrical member having a circumferential portion of its side wall intermediate its ends removed to define a remaining arcuate side wall portion with the circumferentially spaced sides thereof defining its said impact face and return face.

20. The percussive rotational impact wrench assembly according to claim 19, wherein said fluid conducting ports and passageways in said hammer member comprise a circumferential impact passageway and a circumferential return passageway formed in an outer surface of said reduced diameter portion and extending partially around the circumference thereof and having opposed facing ends terminating a distance apart;

a pressurized air supply port extending longitudinally through said hammer side having an inlet at one end thereof and an outlet exiting through exterior of said reduced diameter portion between said opposed facing ends of said impact and return passageways; and an impact air exhaust port and a return air exhaust port extending through said reduced diameter portion to the interior of said hammer member in circumferentially spaced relation; and said fluid conducting ports and passageways in said piston member comprise a circumferential slotted passageway extending through said arcuate side wall portion with outer ends terminating a distance inwardly from its said impact face and return face, and lateral portions of said arcuate side wall at each side of said passageway outer ends defining an impact sealing surface and a return sealing surface for alternately opening and closing said impact air exhaust port and return air exhaust port and communication through said impact passageway and return passageway.

* * * * *